United States Patent [19]

Handsman

[11] 4,125,211

[45] Nov. 14, 1978

[54] CAMERA SUPPORTING STRAP

[75] Inventor: Frederic B. Handsman, Bayside, N.Y.

[73] Assignee: Ehrenreich Photo-Optical Industries, Inc., Garden City, N.Y.

[21] Appl. No.: 731,942

[22] Filed: Oct. 13, 1976

[51] Int. Cl.[2] ..... A45F 5/00

[52] U.S. Cl. ..... 224/5 V; 224/5 R

[58] Field of Search ..... 224/5 R, 5 A, 5 B, 5 BC, 224/5 E, 5 F, 5 G, 5 H, 5 MA, 5 MC, 5 N, 5 P, 5 Q, 5 S, 5 V, 5 Y, 5 Z, 6; 2/230, 300, 310, 312, 331, 332; 182/3; 240/59; 43/21.2, 54.5 R; D87/1 R, 1 A; D2/382, 387, 400, 404, 381; 354/293

[56] References Cited

U.S. PATENT DOCUMENTS

| | | | |
|---|---|---|---|
| 552,378 | 12/1895 | Krebs | 2/232 |
| 982,376 | 1/1911 | MacFarlane | 224/6 |
| 1,672,535 | 6/1928 | McNamara | D2/404 X |
| 2,318,924 | 5/1943 | Cohn | D2/404 X |
| 2,538,576 | 1/1951 | Mavrakis | 224/5 G |
| 2,643,803 | 6/1953 | Bates | 224/5 V |
| 2,970,316 | 2/1961 | Silin | 224/5 P X |
| 3,106,350 | 10/1963 | Wiltse et al. | 354/293 X |
| 3,602,409 | 8/1971 | Kerns | 224/5 V |
| 3,893,604 | 7/1975 | Skinner | 224/5 R X |

*Primary Examiner*—Trygve M. Blix
*Assistant Examiner*—Winston H. Douglas
*Attorney, Agent, or Firm*—Roy C. Hopgood; John M. Calimafde; Charles W. Neill

[57] ABSTRACT

This strap goes over the shoulders of the person wearing it and supports one or more cameras hanging down in front of the body of the wearer. Portions of the strap that extend downward behind the shoulders converge toward one another and are connected with a stretchable or elastic part of the strap which has its lower end anchored to a trouser band or belt, and which prevents the converging parts of the strap from moving upward into contact with the back of the neck of the person wearing the strap. Thus the weight of the cameras never bears against the neck. The stretchable part of the back portion of the strap yields when the wearer bends forward, and this prevents uncomfortable tightening of the strap.

8 Claims, 5 Drawing Figures

CAMERA SUPPORTING STRAP

BACKGROUND AND SUMMARY OF THE INVENTION

In order to have a camera in position for convenient use at any time, it is a common practice to support the camera, hanging in front of the body of the user, from a strap which passes around the neck of the camera user. It has also become common for a person to wear two cameras, one hanging below the other, for use with different kinds of lenses and films, depending upon the particular picture to be taken.

It is very convenient to have a camera hanging in a centered position in front of the body; but some cameras are objectionably heavy, particularly when equipped with elaborate lens systems for telephoto work; and the weight of such a camera hanging around the neck strap is uncomfortable. When there are two cameras hanging at different levels of the strap, the added weight of the second camera makes the strap even more uncomfortable.

This invention is a novel strap which holds the cameras in the same convenient positions as a neck strap; but the strap of this invention is supported entirely from the shoulders and has no part which bears against the back of the neck. The downwardly extending portions of the strap pass over the shoulders and then converge as they extend downward behind the shoulders. The converging portions of the strap are held down by a stretchable portion of the strap which is anchored to the waist band or belt of the trousers or skirt of a person wearing the belt.

The stretchable portion of the strap is preferably detachable from the remainder of the strap; but when attached, is held centered on the converging strap portions so as to distribute the pull on the shoulders substantially evenly. The connection at the lower end of the stretchable portion can be clamped or clipped to the garment to which it is connected, or can be used as a loop through which a belt is passed.

The front portions of the strap have conventional adjustments for their length to determine the level at which the lower camera is supported; and they also have connections for the upper camera which are adjustable independently of the length of the strap to obtain any desired spacing between the upper and lower cameras.

Another advantage of the stretchable portion of the back of the strap is that it holds the strap down when the user raises the upper camera, with the camera on short supporting connections, to eye height for making an exposure.

Other objects, features and advantages of the invention will appear as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
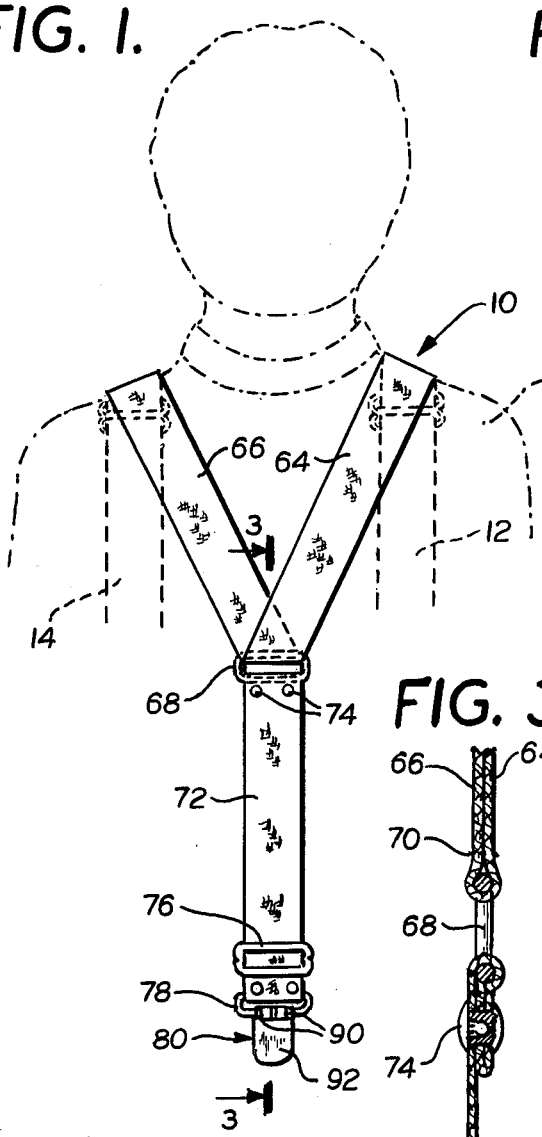
FIG. 1 is an elevation view showing the back portion of the strap as worn by a user of the strap.

The camera strap, designated generally by the reference character 10, includes two front portions 12 and 14 which extend over the shoulders of a wearer, shown in broken lines and designated by the reference character 16. The front portions 12 and 14 extend downwardly and generally parallel to one another.

At the lower ends of the front portions 12 and 14, there are connections 20, each having a part 22 supported by a loop 24 at the lower end of the strap portion 12 or 14. Each of the connections 20 has a snap fastener 26 that fits into a loop 28 by which a camera 30 is supported.

Figure 5:
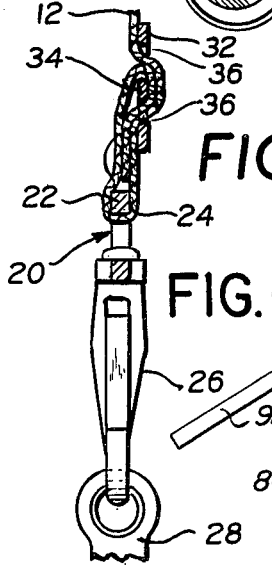
Figure 6:
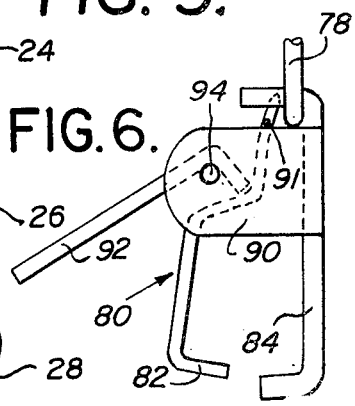
FIG. 6 is an elevation of the clamp for securing the strap to a belt, the clamp being shown in its open position.

FIG. 5 shows the lower end of the strap portion 12 in section. The end of the strap portion 12 is secured to a buckle 32 at a connection 34.

From this connection 34, the strap portion 12 extends downward through the connection 20 and then around the part 22 and upward through parallel horizontal slots 36 of the buckle 32. By pulling the upper part of the strap portion 12 through the upper slot 36, so as to accumulate slack between the slots 36, the connection 34 can be advanced upward along the strap portion 12 so as to shorten the overall length of the strap in accordance with a conventional procedure.

An upper level camera 40 has loops 42 at its opposite sides connected with connections 20' which are similar to the connections 20 except for size. These connections 20' have snap fasteners 26' for holding the loops 42'.

Figure 4:
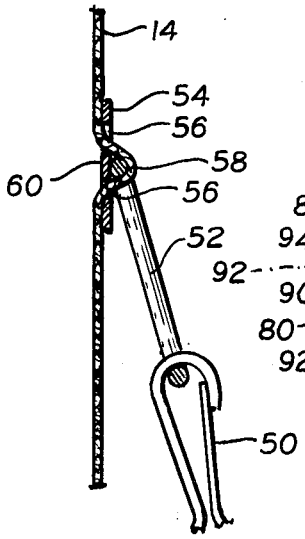

Short connector straps 46 join the connections 20 with upper connections 48 which have snap fasteners 50 that hook over links 52 which are adjustable up and down along the front portions 12 and 14. FIG. 4 shows the way in which the link 52 is supported from the forward portion 14 of the strap. There is a buckle 54, preferably made of metal or other stiff material, with parallel slots 56 through which the strap portion 14 extends. This provides a loop 58 on the right-hand side of the buckle 54 in FIG. 4. The upper transverse portion of the link 52 extends between the loop 58 and an intermediate part 60 between the slots 56 of the buckle 54.

By moving the strap portion 54 so as to accumulate slack in the loop 58, the buckle 54 and the link 52 can be moved upward or downward along the strap portion 14 to raise and lower the upper level camera which is supported from the link 52.

Figure 2:
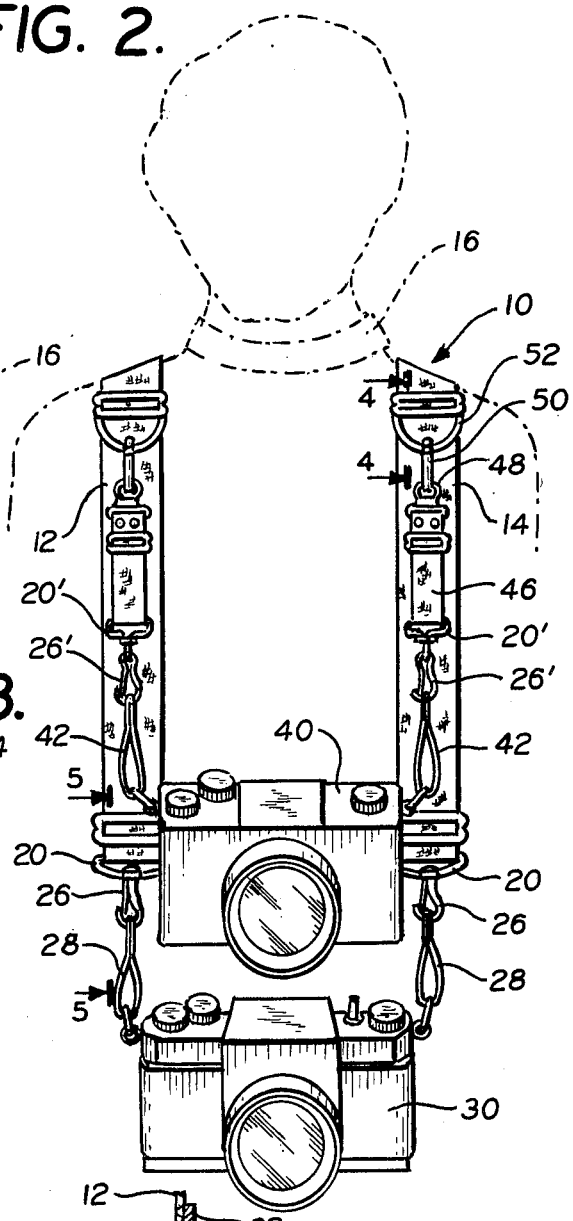
FIG. 2 shows the front portion of the strap with two cameras supported from the strap at different levels.

The advantage of the construction shown in FIG. 4, combined with the structure shown in FIG. 2, is that the level of the upper camera can be adjusted independently of the level of the lower camera and without making any adjustment in the length of the strap portion 14.

Figure 3:
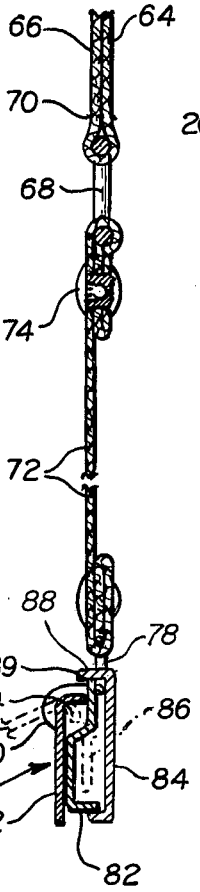
FIGS. 3, 4 and 5 are enlarged sectional views taken on the lines 3—3, 4—4 and 5—5, respectively.

FIG. 1 shows the way in which the forward strap portions 12 and 14 pass over the shoulders of a wearer and have downwardly extending portions 64 and 66 which converge as they extend downwardly to a connector 68. This connector 68 is preferably a rectangular metal loop, as shown in FIG. 3. The converging strap portions 64 and 66 are preferably of one-piece construction and they are held against movement with respect to the loop 68 by stitching 70 which extends in a line across the converging strap portions 64 and 66 immediately above the upper part of the connector 68.

A stretchable or elastic strap portion 72 is secured to the lower part of the connector 68 by looping the upper part of the stretchable portion 72 over the lower part of the connector 68 and then connecting this upper part to the rest of the portion 72 by snap fasteners 74. This provides a secure connection between the converging portions 64 and 66 and the lower stretchable strap portion 72.

The strap portion 72 is preferably made of elastomer material woven to form a web. It is of adjustable length by adjustment means 76, similar to the strap adjusting means shown in FIG. 5 and already described.

At the lower end of the strap portion 72, there is a connector 78 which joins the strap portion 72 to an anchor or clip 80. A sectional view of this anchor 80 is shown in FIG. 3. It has two parts 82 and 84 which are connected together by a pivotal connection 88, and which can be moved into closed position, as shown in FIG. 3, to clamp a part of a garment between them, such as the waist band of a skirt or trousers. A belt, indicated in dotted lines and by the reference character 86, can be passed between the parts 82 and 84 which form a loop when in closed position, as shown in FIG. 3. The fact that these parts can move about their pivoted connection 88 to open the loop permits the lower end of the strap portion 72 to be applied to the belt 86 without threading the end of the belt through the loop.

The pivot connection 88 is formed by projections at the top of the part 82 extending into recesses in a forwardly bent top flange 89. The part 82 is held in the recesses by extensions projecting from both sides of the part 82 immediately above tabs 90 that extend forward from opposite sides of part 84. One of the tabs 90 is shown in FIG. 3 and both of them can be seen in FIG. 1.

A locking element 92, when moved into the position shown in full lines in FIG. 3, holds the parts 82 and 84 together in their clamping position, and this locking element 92 must be swung about a pivotal connection 94 in order to permit the parts 82 and 84 to move apart about their pivotal connection 88. The locking element 92 is a lever with side extensions projecting into openings in the tabs 90 to provide the pivotal connection 94 about which the locking element 92 can swing clockwise into the dotted line position shown in FIG. 3. The upper end of the locking element 92 extends to the right and into contact with the part 82 to hold the parts 82 and 84 in closed position. When the locking element 92 is moved into its dotted line position, the part 82 can move away from the part 84 far enough to release the anchor 80 from a garment and to permit the belt 86 to be put in or taken out of the anchor.

The anchor 80 is shown on a small scale in the drawing and may be regarded as a diagrammatic showing of means for anchoring the lower end of a strap to a belt or waist band. Such clips or anchors are well-known in the art and an example of one is shown in U.S. Pat. No. 3,893,604 (issued July 8, 1975).

The elastic portion 72 is intended to be adjusted as to length, so that when the strap is worn and attached to a waist band or a belt, the strap portion 72 is not stretched, but it holds the upper portions of the strap down on the wearer's shoulders, as shown in FIGS. 1 and 2. When the cameras are in use, particularly the upper level camera, the strap may be pulled forward from the shoulders, and when this occurs, the elastic portion 72 yields to prevent what would otherwise be an uncomfortable pull on the strap. Whenever a person wearing the strap bends forward so that the back is curved, it is necessary for the elastic portion 72 to stretch in order to avoid uncomfortable tightening of the strap in an up and down direction. At all times, the elasticity of the strap portion 72 provides a flexibility, and, if the adjustments are made so that the portion 72 is slightly stretched under normal conditions, this can be used to keep the entire strap assembly taut and yet avoid any binding or discomfort as the result of movements of the wearer or the cameras.

The preferred embodiment of the invention has been illustrated and described, but changes and modifications can be made and some features can be used in different combinations without departing from the invention as defined in the claims.

What is claimed is:

1. A camera strap being adapted for supporting cameras in front of the body of a person wearing the strap, said strap including in combination two front portions of the strap extending downward and generally parallel to one another from the shoulders of the wearer and being generally flat against the wearer's body, detachable supporting means on each of the front generally parallel portions of the straps for supporting two cameras at a location between the straps and at different levels in front of the body, extensions of the front portions of the straps extending over the shoulders of the wearer and part way down the back of the wearer, and converging downwardly along the back of the wearer at an acute angle to one another to a vertex at a location intermediate the shoulders and waist of the wearer, and an elastic strap portion connected at its upper end with the extensions of the front portions at the intermediate location, means for anchoring the elastic strap portion to a belt or trouser band, the front portions of the strap being resistant to stretching under the weight of the cameras with which the strap is intended to be used, and the extensions of the front portions of the strap extending in directions to avoid contact with the back of the neck of a person wearing the strap, and the elastic strap portion holding the strap away from the wearer's neck but being stretchable to accommodate any forward bending of the body of the wearer, the detachable supporting means for an upper level camera extending downward and overlying the front surfaces of said generally parallel front portions of the strap the bottom ends of which are connected to the detachable supporting means for a lower level camera whereby the different level camera supporting means accommodate cameras of equal width, said detachable supporting means for an upper level camera being adjustable up and down along the front portions of the strap to regulate the difference in the levels of the cameras, and non-swivel connectors at the lower ends of said supporting means to hold the cameras facing forward and to prevent each camera from rolling about a horizontal axis.

2. The camera strap described in claim 1 characterized by said extensions converging as they extend downward, the stretchable back portion being in position to prevent the converging extensions from moving upward to the back of the neck of the wearer of the strap as a result of downward pull by the weight of the cameras hanging on the front portion of the strap, said elastic strap portion having a top connection for joining the stretchable part to the converging extensions, and said means for anchoring the elastic strap portion comprising a bottom connector at a lower end of the elastic strap portion for anchoring the elastic strap portion to a belt, trouser band or other element of clothing that normally maintains a substantially constant level during picture-taking by the person wearing the belt.

3. The camera strap described in claim 1 characterized by the lower ends of both of the converging extensions being portions of a continuous flat strap, a ring connected to the upper end of the stretchable portion of the assembly and through which the continuous strap extends with different sides of the strap facing outward after passing through the ring, and means securing the parts of the continuous strap together at opposite sides of the ring to prevent the continuous strap from sliding within the ring, the strap being free of any connections, between the front portions of the strap and the extensions that pass over the shoulders, at locations intermediate the shoulders and waist of the wearer, said means for anchoring the elastic strap portion comprising a clip at the lower end of the elastic strap portion for gripping an upper end of the wearer's trousers or a belt of said trousers, and manually releasable means for holding the clip closed.

4. The camera strap described in claim 1 characterized by the elastic strap being sufficiently elastic to accommodate any forward bending of the back of the wearer without reaching its elastic limit.

5. The camera strap described in claim 1 characterized by the front portions of the strap having means for adjusting their length to determine the level at which the lower level camera is supported.

6. The camera strap described in claim 1 characterized by the extensions of the front portions of the strap converging as they extend downward and being of one-piece construction with one another and having a loop where they meet at a vertex of convergence, a line of stitching through the straps for maintaining the loop, and an element of the connector of the stretchable portion to the converging strap extensions, which element extends through said loop.

7. The camera strap described in claim 1 characterized by a detachable connection between the elastic strap portion and the extensions of the front portions of the strap.

8. The camera strap described in claim 1 characterized by said means for anchoring the elastic strap portion comprising a clip at a lower end of the elastic strap portion for anchoring the elastic strap portion to a belt including a loop through which a belt can pass, and releasable mechanism operable to open the loop so that the loop can be put around the belt, or removed therefrom, without passing an end of the belt through the loop.

* * * * *